US011152700B2

(12) United States Patent
Shi et al.

(10) Patent No.: US 11,152,700 B2
(45) Date of Patent: Oct. 19, 2021

(54) BEAM STEERING ANTENNA TRANSMITTER, MULTI-USER ANTENNA MIMO TRANSMITTER AND RELATED METHODS OF COMMUNICATION

(71) Applicant: Phase Sensitive Innovations, Inc., Newark, DE (US)

(72) Inventors: Shouyuan Shi, Newark, DE (US); Dennis Prather, Newark, DE (US); Janusz Murakowski, Bear, DE (US); Matthew Konkol, Newark, DE (US)

(73) Assignee: Phase Sensitive Innovations, Inc., Newark, DE (US)

( * ) Notice: Subject to any disclaimer, the term of this patent is extended or adjusted under 35 U.S.C. 154(b) by 169 days.

(21) Appl. No.: 16/386,196

(22) Filed: Apr. 16, 2019

(65) Prior Publication Data

US 2019/0319356 A1 Oct. 17, 2019

Related U.S. Application Data

(60) Provisional application No. 62/658,245, filed on Apr. 16, 2018.

(51) Int. Cl.
*H01Q 3/26* (2006.01)
*H01Q 5/22* (2015.01)
(Continued)

(52) U.S. Cl.
CPC ..... *H01Q 3/2676* (2013.01); *H01Q 5/22* (2015.01); *H01Q 21/22* (2013.01); *H01Q 21/24* (2013.01)

(58) Field of Classification Search
CPC ..... H01Q 3/2676; H01Q 5/22; H01Q 21/24; H01Q 21/22
See application file for complete search history.

(56) References Cited

U.S. PATENT DOCUMENTS 4,929,956 A 5/1990 Lee et al.
5,677,697 A 10/1997 Lee et al.
(Continued)

FOREIGN PATENT DOCUMENTS

EP 0793291 B1 4/2003
JP 2010081550 A 4/2010
(Continued)

OTHER PUBLICATIONS

International Search Report and Written Opinion for corresponding PCT application PCT/US19/27771, dated Jul. 12, 2019.
(Continued)

*Primary Examiner* — Renan Luque
(74) *Attorney, Agent, or Firm* — Muir Patent Law, PLLC

(57) ABSTRACT

In the disclosed optically-fed transmitting phased-array architecture, transmitting signals are converted between the electrical domain and the optical domain by using electro-optic (EO) modulators and photodiodes. RF signal(s) generated from a relatively low frequency source modulate an optical carrier signal. This modulated optical signal can be remotely imparted to photodiodes via optical fibers. Desired RF signals may be recovered by photo-mixing at the photodiodes whose wired RF outputs are then transmitted to radiating elements of the antennas. The antenna array may generate a physical RF beam that transmits an RF signal that is focused on one or more selectable locations. Multiple RF beams may be simultaneously generated, each RF beam being capable of being directed to focus on a unique location or set of locations.

12 Claims, 9 Drawing Sheets

(51) Int. Cl.
*H01Q 21/24* (2006.01)
*H01Q 21/22* (2006.01)

(56) References Cited

U.S. PATENT DOCUMENTS

| | | | | |
|---|---|---|---|---|
| 6,442,148 | B1 | 8/2002 | Adams et al. | |
| 6,496,158 | B1 * | 12/2002 | Ksienski | H01Q 3/36 342/374 |
| 7,084,811 | B1 | 8/2006 | Yap | |
| 7,835,455 | B2 | 11/2010 | Shattil | |
| 9,753,351 | B2 | 9/2017 | Eldada | |
| 2008/0055175 | A1 | 3/2008 | Rebeiz et al. | |
| 2009/0027268 | A1 * | 1/2009 | Coward | H01Q 3/22 342/375 |
| 2019/0157757 | A1 * | 5/2019 | Murakowski | H01Q 21/0075 |
| 2020/0365988 | A1 * | 11/2020 | Bourderionnet | H04B 10/2575 |

FOREIGN PATENT DOCUMENTS

| | | | |
|---|---|---|---|
| WO | 2017117584 | A1 | 7/2017 |
| WO | 2018109840 | A1 | 6/2018 |

OTHER PUBLICATIONS

A. A. Sawchuk et al, "Geometries for Optical Implementations of the Perfect Shuffle", Proceedings of SPIE, vol. 0963, Aug. 29, 1988 (Aug. 29, 1988), p. 270.

Caroline B Elizabeth et al, "Performance analysis and comparison of optical signal processing beamforming networks: a survey", Photonic Network Communications, Klumer Academic Publishers, Dordrecht, NL, Oct. 9, 2018 (Oct. 9, 2018), vol. 37, No. 1, p. 38-52.

Te-Kao Wu et al, "Optical Beam Forming Techniques for Phased Array Antennas", International Journal of Infrared and Millimeter Waves, Springer, Dordrecht, NL, vol. 14, No. 6, Jun. 1, 1993 (Jun. 1, 1993), p. 1191-1199.

International Search Report and Written Opinion of the International Searching Authority mailed in connection with PCT/US2019/035197, dated Feb. 6, 2020, 11 pages.

International Search Report and Written Opinion of the International Searching Authority mailed in connection with PCT/US2020/034041, Sep. 4, 2020, 11 pages.

* cited by examiner

BEAM STEERING ANTENNA TRANSMITTER, MULTI-USER ANTENNA MIMO TRANSMITTER AND RELATED METHODS OF COMMUNICATION

RELATED APPLICATION

This application is a non-provisional application of provisional Application U.S. No. 62/658,245 filed Apr. 16, 2018, the entire contents of which are hereby incorporated by reference. This application is related to U.S. provisional Application 62/280,673 filed Jan. 19, 2016 and U.S. non-provisional application Ser. No. 15/410,761, the entire contents of each of these applications being hereby incorporated by reference.

FIELD OF TECHNOLOGY

The subject matter described herein relates to antenna array formed to transmit information via a radio-frequency beam focused on a selected location. In some examples, multiple communication channels may be transmitted simultaneously to different locations. The transmitter may be formed by an array of optically fed antennas.

BACKGROUND

Conformal, low profile, and wideband phased arrays have received increasing attention due to their potential to provide multiple functionalities over several octaves of frequency, using shared common apertures for various applications, such as radar and communications.

SUMMARY

In the disclosed optically-fed transmitting phased-array architecture, transmitting signals are converted between the electrical domain and the optical domain by using electro-optic (EO) modulators and photodiodes. RF signal(s) generated from a relatively low frequency source modulate an optical carrier signal. This modulated optical signal can be remotely imparted to photodiodes via optical fibers. Desired RF signals may be recovered by photo-mixing at the photodiodes whose wired RF outputs are then transmitted to radiating elements of the antennas.

The antenna array may generate a physical RF beam that transmits an RF signal that is focused on one or more selectable locations. Multiple RF beams may be simultaneously generated, each RF beam being capable of being directed to focus on a unique location or set of locations.

BRIEF DESCRIPTION OF THE DRAWINGS

The accompanying drawings are included to provide a further understanding of exemplary device, system and method embodiments of the invention. In the drawings.

DETAILED DESCRIPTION

Figure 1A:
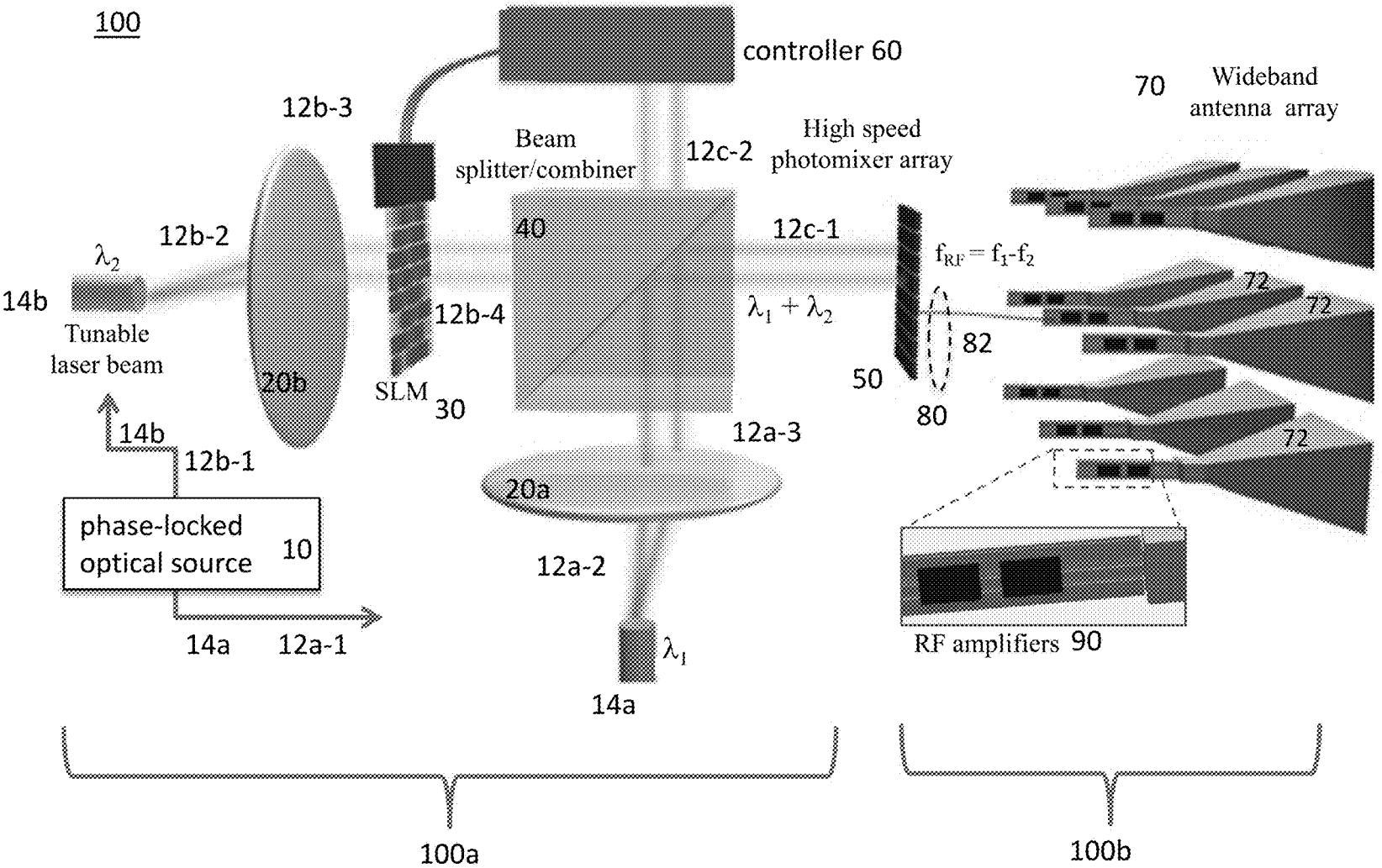
FIGS. 1A and 1B illustrate one example embodiment of an antenna transmitter.

The present disclosure now will be described more fully hereinafter with reference to the accompanying drawings, in which various exemplary implementations are shown. The invention may, however, be embodied in many different forms and should not be construed as limited to the exemplary implementations set forth herein. These example exemplary implementations are just that—examples—and many implementations and variations are possible that do not require the details provided herein. It should also be emphasized that the disclosure provides details of alternative examples, but such listing of alternatives is not exhaustive. Furthermore, any consistency of detail between various examples should not be interpreted as requiring such detail—it is impracticable to list every possible variation for every feature described herein. The language of the claims should be referenced in determining the requirements of the invention.

In the drawings, the size and relative sizes of layers and regions may be exaggerated for clarity. Like numbers refer to like elements throughout. Though the different figures show variations of exemplary implementations, these figures are not necessarily intended to be mutually exclusive from each other. Rather, as will be seen from the context of the detailed description below, certain features depicted and described in different figures can be combined with other features from other figures to result in various exemplary implementations, when taking the figures and their description as a whole into consideration.

The terminology used herein is for the purpose of describing particular exemplary implementations only and is not intended to be limiting of the invention. As used herein, the singular forms "a", "an" and "the" are intended to include the plural forms as well, unless the context clearly indicates otherwise. As used herein, the term "and/or" includes any and all combinations of one or more of the associated listed items and may be abbreviated as "/".

It will be understood that when an element is referred to as being "connected" or "coupled" to or "on" another element, it can be directly connected or coupled to or on the other element or intervening elements may be present. In contrast, when an element is referred to as being "directly connected" or "directly coupled" to another element, or as "contacting" or "in contact with" another element, there are no intervening elements present. Other words used to describe the relationship between elements should be interpreted in a like fashion (e.g., "between" versus "directly between," "adjacent" versus "directly adjacent," etc.). As used herein, elements described as being "electrically connected" are configured such that an electrical signal can be passed from one element to the other. Similarly, "optically connected" or "in optical communication" may be used refer to elements configured such that an optical signal can be passed from one element to another.

Terms such as "about" or "approximately" or "on the order of" may reflect amounts, sizes, orientations, or layouts that vary only in a small relative manner, and/or in a way that does not significantly alter the operation, functionality, or structure of certain elements.

Use of ordinal numbers "first" "second" "third" etc., may be used as labels in this application simply to distinguish one element from another. As these ordinal numbers are typically used in a sequence corresponding to the introduction of the otherwise similarly named elements (a sequence that may be different in different claims and/or the specification), it may be the case that different ordinal numbers may be used to refer to the same/similar element. Thus, a term that is referenced with a particular ordinal number (e.g., "first" in a particular claim) may be referenced elsewhere with a different ordinal number (e.g., "second" in the specification or another claim).

FIG. 1A illustrates one example embodiment of an antenna transmitter 100. The RF carrier frequency of the antenna transmitter 100 may be generated optically using phase locked optical source 10. The phase locked optical source 10 may be provided in various implementations, for example, (a) mode-locked laser with two optical filters, and (b) frequency controlled or optical phase lock loop (OPLL) based tunable lasers. In the former approach (a), optical comb produced in the mode-locked laser provides locked phase between different tones. The comb can be split and fed into two different optical filters to pick up any two of these tones from the comb (e.g., any two of the harmonics of the comb), thereby producing a pure RF signal by photomixing at the photodiode. The latter approach (b) one introduces optical feedback loop to lock two tunable lasers to minimize phase noise between them, in which the use of EO-based optical lasers offers fast tunability of optical laser generations, and thus, the RF signal.

The phase locked optical source 10 generates two light beams 12*a*, 12*b*, represented at the output of the phased locked optical source as 12*a*-1, 12*b*-1. It should be appreciated that use of reference numerals 12*a*, 12*b* refer generally to these two light beams, while reference numerals having suffixes added to these reference numerals 12*a*, 12*b* (e.g., 12*a*-1, 12*b*-1) may be used to identify a particular configuration or stage of the light beams 12*a*, 12*b*. It should also be appreciated that combined beams 12*c*-1, 12*c*-2 (discussed below) are formed by combining light beams 12*a*, 12*b* and thus should be understood to still include light beams 12*a*, 12*b* (in their combined form).

Figure 2:
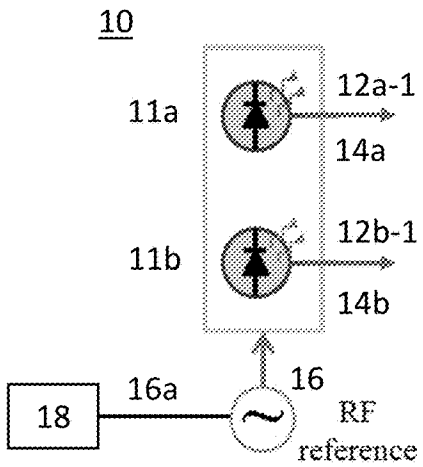
FIG. 2 is a simplified block diagram of a phase locked optical source that may be implemented in the embodiments described here.

The wavelengths (and frequencies) of light beams 12*a*-1 and 12*b*-1 are offset by a fixed amount (although this fixed offset may be adjusted). The lasers may be correlated by injection locking, and the wavelength offset between the light beams 12*a*-1, 12*b*-1 emitted by the lasers is determined by an RF reference source (e.g., an RF electrical signal output by the RF reference source). FIG. 2 is a simplified block diagram illustrating phase locked optical source 10 comprising laser 11*a* and 11*b* emitting light beams (laser beams) 12*a*-1 and 12*b*-1 on optical fibers 14*a* and 14*b*, respectively. The frequency difference between the light beams 12*a*-1 and 12*b*-1 may be the frequency of RF reference source 16 of the phase locked optical source 10 or an integer multiple thereof. As described in further detail herein, the frequency difference between the light beams 12*a*-1 and 12*b*-1 may be the RF carrier frequency of the antenna transmitter 100. The RF reference source 16 of the phase locked optical source 10 may be a voltage controlled oscillator so that the RF signal generated by the RF reference source (and the correlated RF carrier frequency of the antenna transmitter 100) is adjustable, being responsive to a voltage input 16*a* of the voltage controlled oscillator/RF reference source 16. This voltage input 16 may be adjustable in real time (or for adjusted different uses of the antenna transmitter 100) to adjust the corresponding frequency band of the antenna transmitter 100. The voltage input to control the RF frequency of the RF signal generated by the RF reference source 16 (and the corresponding RF carrier frequency of the antenna transmitter 100), may be selectable by a user of the antenna transmitter 10 or during manufacture of the antenna transmitter 10, such as by being generated responsive to a programmable controller or other computer configured by software, switches, codes provided by a programmable fuse bank, etc. (generically represented in FIG. 2 by controller 18).

Such modification of the RF frequency and corresponding RF carrier frequency of the antenna transmitter 10 allows the same antenna transmitter 100 to be used with a variety of RF carrier frequencies, which may only limited by bandwidths of frontend components, such as antennas and RF amplifiers (driving such antennas). In the event desired RF carrier frequencies of the antenna transmitter 10 fall outside operating ranges of frontend components (e.g., antennas, RF amplifiers and/or RF transmission lines connecting the same), the user and/or manufacturer may select and/or replace such frontend components with other frontend components that are optimized to operate with the desired RF carrier frequency (or frequencies). It will also be appreciated that the same backend of the antenna transmitter 10 may be used with several frontends that operate at different RF carrier frequencies, where a demultiplexer (or controllable switch) may select which frontend may be operably connected to and controlled by the backend. Thus, the bandwidth of the antenna transmitter 100 may be formed by a combination of two or more frontends, where some or all of these frontends have operational frequencies lying outside operational frequencies of other frontends. Further exemplary details of an antenna transmitter having a backend that may operate with multiple frontends (via swapping, multiplexing, etc.) that may be used with the present invention are disclosed in U.S. application Ser. No. 16/198,652 filed Nov. 21, 2018, the contents of which are hereby incorporated by reference.

In some examples, the phase locked optical source 10 may be a tunable optical paired source (or TOPS) comprising the pair of lasers 11*a*, 11*b* that respectively emit light beams 12*a*-1 and 12*b*-1. Further details of exemplary TOPS operation and structure are disclosed in provisional Application No. 62/289,673, U.S. non-provisional application Ser. No. 15/410,761 and Schneider et al. "Radiofrequency signal-generation system with over seven octaves of continuous tuning," *Nat. Photonics*, vol. 7, no. 2, pp. 118-122, February 2013.

It will be appreciated that the optical beams 12*a*-1 and 12*b*-1 are processed differently as compared to Application No. 62/289,673 and U.S. non-provisional application Ser. No. 15/410,761. As shown in FIG. 1A, the optical beams 12*a*-1 and 12*b*-1 of the phase locked optical source 10 are output on separate optical fibers 14*a* and 14*b* and emitted from the fibers 14*a* and 14 to spatially diverge (such as being emitted in free space or a transparent medium such as glass (or other lens materials)).

The optical beams 12*a*-1 and 12*b*-1 thus form diverged optical beams 12*a*-2 and 12*b*-2. Each of the diverged optical beams 12*a*-2, 12*b*-2 are captured by a respective collimating lens 20*a*, 20*b* to form respective collimated optical beams 12*a*-3, 12*b*-3. It should be appreciated that although FIG. 1A illustrates each of the optical beams 12*a*-2, 12*b*-2, 12*a*-3, 12*b*-3 to have two separate discrete components, this is for the purposes of illustration only. For example, optical beams 12*a*-2, 12*b*-2 may have a cone shape or pyramid shape while optical beams 12*a*-3, 12*b*-3 may have a cylindrical or parallelepiped shape.

Although not shown in FIG. 1A, the antenna transmitter 10 may include one or more masks formed of opaque light blocking material with an opening (or a plurality of smaller openings) therein to block portions of the light beams that will be projected on locations outside the downstream elements of the transmitter 10. E.g., such a mask may be inserted between collimating lens 20*a* and beam splitter/combiner 40 and have a single opening corresponding in shape to the shape of the active portion (sensor array) of the high speed photomixer array 50. Alternatively, such a mask may have a plurality of openings, each corresponding to a location of a photodiode of the photomixer array 50.

Collimated beams 12*a*-3 and 12*b*-3 are then transmitted to beam splitter/combiner 40. Prior to input into beam splitter/combiner 40, collimated beam 12*b*-3 may be subject to spatial filtering by spatial light modulator 30 to form modulated beam 12*b*-4. The modulated beam 12*b*-4 and collimated beam 12*a*-3 are input to beam splitter/combiner 40 where they are combined and split to form combined beams 12*c*-1 and 12*c*-2. The beam splitter/combiner 40 may comprise a partially transparent mirror having surfaces that partially reflect and partially receive the optical beams 12*a*-3, 12*b*-4 as shown. As shown in FIG. 1A, one of the combined beams 12*c*-1 is transmitted to be impinged on and sensed by a high speed photomixer array 50. The other of the combined beams 12*c*-2 is transmitted to controller 60 where it is sensed and used to provide phase feedback control by the controller 60 (via control of the SLM 30).

Photomixer array 50 may comprise an array of high speed photodiodes 52, each photodiode 52 generating an RF electrical signal corresponding to the portion of the combined beam 12*c*-1 it senses. Each photodiode 52 may be connected to a corresponding antenna element 72 of the wideband antenna array 70. Specifically, a photodiode 52 of photomixer array 50 provides an RF electrical signal that controls operation of the corresponding antenna element 72 to which it is connected. Only one connection between a photodiode 52 of photomixer array 50 and an antenna element 72 of antenna array is shown in FIG. 1A, however, each photodiode 52 is provided with a separate, dedicated connection.

As shown in FIG. 1A, additional electrical components may be provided to facilitate the connection of the photomixer array 50 and antenna array 70, such as RF transmission lines 80 (only one (82) shown for clarity of the figure), RF amplifiers 90, RF filters (not shown), etc. The RF signal of a photodiode 52 may be received and transmitted via a corresponding RF transmission line (e.g., a microstrip, stripline, coaxial line, etc.) and received and amplified by a corresponding RF amplifier 90, and such RF amplified signal may be used to drive a corresponding antenna 72. In other embodiments, use of RF amplifiers and/or RF transmission lines in the frontend may be avoided altogether. For example, the structure and operation described with respect to operation of antennas/antenna array in U.S. patent application Ser. No. 15/242,459 may be implemented, such application being incorporated by reference for such detail.

In the example of FIG. 1A, the phased-locked optical sources 10, the collimating lenses 20*a*, 20*b*, SLM 30, beam splitter/combiner 40, photomixer array 50, controller 60, and connections formed therebetween may form the frontend 100*a* of the antenna transmitter 100. The elements connected downstream of the photomixer array 50 may form the frontend 100*b* of the antenna transmitter 100, including antenna array 70 as well as one or more of the RF transmission lines 80, RF amplifiers 90 and/or RF filters (not shown).

In operation, the architecture of the transmitter 10 uses light of two different wavelengths, with the respective sources phase-locked to one another, to generate an RF wave-front (a beam or multiple beams) output from the antenna array 70. The RF wave-front originates in optical domain where the wave-front of light of one of the optical wavelengths (lambda 2) is modulated with SLM (spatial light modulator) 30 before combining it with light of the other wavelength (lambda 1) using beam splitter/combiner 40. As shown in FIG. 1, light beams 14*a*, 14*b* of both phase-locked lasers are routed through two optical fibers 14*a*, 14*b* to the free space optical system with each of the two fiber ends placed on respective optical axes of corresponding collimating optical lenses 20*a*, 2*b*. In this way, the optical lenses produce two collimating beams 12*a*-3, 12*b*-3 before they combine together. Without the SLM 30, uniform phase distributions for both optical signals 12*a*, 12*b* can be achieved at a plane where high-speed detector photomixer array 50 is located. The SLM 30 is controlled by controller 60 to configure the optical wavefront of combined beam 12*c*-1 received by photomixer 50 to cause beam formation of the RF electromagnetic signal output by the antenna array 70. The SLM 30 also provides data modulation. The combined optical beam 12*c*-1 is then detected with the high-speed photo-mixer array 50 coupled to wide-band antenna array 70 through RF amplifiers 90. As a result, the optical wave-front modulated with the SLM becomes a modulated RF wave-front with a carrier frequency determined by the spectral separation of the phase-locked optical sources 12*a*, 12*b*.

In the optical beam-forming transmitter 10, the spatial light modulator (SLM) 30 may comprise a phase-only SLM. For example, SLM 50 may be a liquid crystal (LC) SLM where the SLM pixels (separately controlled SLM elements each formed of a LC material) may have their optical indices (i.e., refractive indices) individually controlled by an applied voltage respectively provided by controller 60. Large analog phase shift of the light beam 12*b* (e.g., selected portions thereof), $>4\pi$, can be generated with a minimum applied voltage, i.e., a few volts. As a result, an electrically addressed SLM 30 provide parallel control of the time delays of the RF signals provided to the antenna array 70. Although the SLM 30 is illustrated as having the light beam 12*b* transmitted therethrough, the SLM 30 may also be formed as a reflective SLM (where beam 12*b* is transmitted through a liquid crystal to a reflector, which then reflects the light back through the liquid crystal).

In addition, the SLM may modulate other characteristics of the light beam 12*b* (in addition to or alternatively to phase modulation). For example, the amplitude of the light beam 12*b* may be modulated, such as by attenuating the intensity of the light beam 12*b* (or portions thereof). For example, the light beam 12*b* may be generated as a polarized light beam and the SLM may rotate a polarization direction of the light beam 12*b*, and the rotated polarized light beam being transmitted through a polarizer. Thus, when the light beam is transmitted through a polarizer having a polarizing direction parallel to that of the polarizer, the light transmitted may correspond to a maximum intensity (and amplitude). When the light beam is transmitted through a polarizer having a polarizing direction orthogonal to that of the polarizer, the light may be fully blocked to correspond to minimum intensity (and amplitude). Intermediate polarization directions (between parallel and orthogonal) provide intermediate intensities of the transmitted beam. Amplitude modulation of the light beam may provide a corresponding amplitude modulation of the RF beat signal of the corresponding combined beam and corresponding amplitude modulate of the generated RF electrical signal (e.g., generated photomixer 50). As noted, both phase and amplitude may be modulated. Thus, QAM modulation may be performed.

It should be appreciated that while only one of the beams 12*a*, 12*b* is modulated, both of the beams may be modulated. For example, providing a second SLM 30 may be interposed between lens 20*a* and beam splitter/combiner 40 that may operate in conjunction with the SLM shown in FIG. 1A (such as providing additional phase and/or amplitude modulation of beam 12*a*). In addition, it should be appreciated that when the system is implemented with a single SLM as shown in FIG. 1A, it may be used to modulate either of beams 12*a*, 12*b* (i.e., when the system is implemented with a tunable laser beam 12*b*, the SLM 30 may modulate the fixed frequency laser beam 12*a* rather than tunable laser beam 12*b*).

The modulation described herein may result in a similarly modulation of one or more spatially separate RF beams generated by the antenna array 70 so that each RF beam may provide encoded data on a channel of the RF beam via such modulation.

Each of the switchable elements, or pixels, of the SLM 30 may be individually controlled (e.g., as with a conventional active matrix liquid crystal display) to separately alter the phase of light passing through. Each portion of beam 12*b* output by an SLM pixel of SLM 30, after combining with a respective portion of beam 12*a* light by beam splitter/combiner 40, is directed onto a corresponding photodiode of the photomixer array 50. The photomixer array 50 comprises a plurality of photodiodes that each operate to convert the received light to an RF electrical signal which is then used to control and/or drive a corresponding antenna element 72 (e.g., one of the horn antennas) of the wide band antenna array 70. The frequency of the electrical signals generated by the photodiodes corresponds to the difference in frequency of the light beams 12*a*, 12*b* (as determined by the phase-locked optical source 10).

Altering the phase of the light passing through an SLM pixel acts to make a corresponding phase change of the RF signal generated by the corresponding photodiode on which such light impinges. For example, changing the phase of light passing through a pixel of the SLM by n degrees (e.g., by 90, 180, 270, etc. degrees) causes the RF signal generated by this corresponding photodiode by n degrees (e.g., by 90, 180, 270, etc. degrees).

Figure 3:
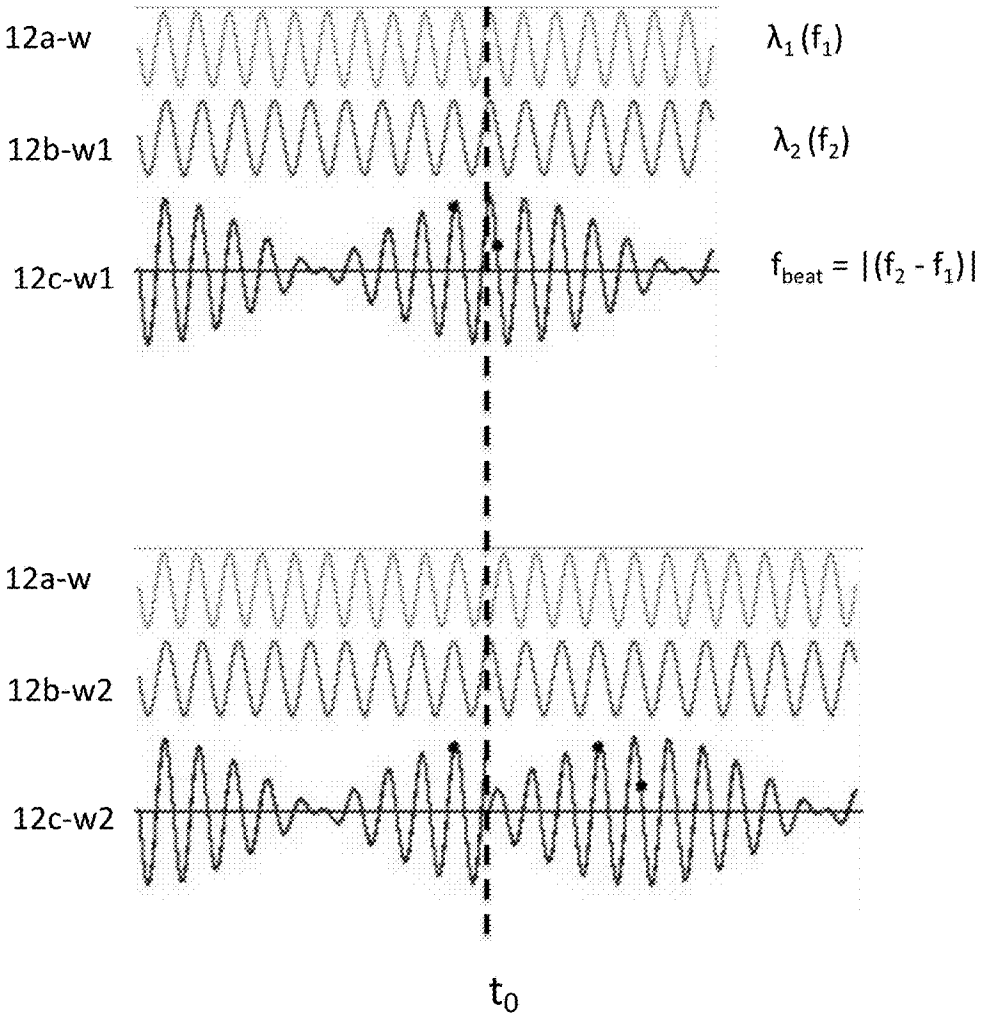
FIG. 3 illustrates the relationship between the wavelength offset between optical beams and the generation of an RF frequency.

FIG. 3 illustrates the relationship between the wavelength offset between optical beams 12*a*, 12*b* and the generation of an RF frequency used to operate an antenna element 72 of array 70. As shown in this example, the waveform 12*a*-*w* of beam 12*a* corresponds to a wavelength/frequency of $\lambda_1/f_1$ while the waveform 12*b*-*w* of beam 12*b* corresponds to a wavelength/frequency of $\lambda_2/f_2$. Waveform 12*c*-*w* represents the waveform of the combination 12*c* of the optical beams 12*a*, 12*b* (e.g., of 12*c*-1 or 12*c*-2 or spatially separated portions thereof). Interference between optical beams 12*a*, 12*b* results in waveform 12*c*-*w* having a beat frequency of $|f_2-f_1|$. This beat frequency of waveform 12*c*-*w* corresponds to the RF frequency, both in amplitude and phase, of the RF electromagnetic wave output by the corresponding antenna 72 (e.g., the antenna element 72 whose operation is controlled by the RF electrical signal generated by the photodiode 52 that receives the combined beam 12*c*-1).

The lower portion of FIG. 3 illustrate waveforms 12*a*-*w*, 12*b*-*w*2 and 12*c*-*w*2 and provide a comparative example to show the effect of phase modulating optical beam 12*b* by 180 degrees at time $t_0$. Comparing 12*c*-*w*1 and 12*c*-*w*2 at time $t_0$, it can be appreciated that phase modulating optical beam 12*b* (here, a phase shift by 180 degrees) at time $t_0$ also causes a corresponding phase modulation of the beat frequency (a corresponding phase shift of 180 degrees) of the combined beam 12*c*. In this example, the previous constructive interference of the beams 12*a*, 12*b* (forming combined beam 12*c*) just prior to $t_0$ is altered to a destructive interference just after to $t_0$.

It can thus appreciated that the phase modulation of the SLM 50 of a portion of the optical beam 12*b* causes a corresponding a corresponding phase modulation of the corresponding portion of the combined beam 12*c* with respect to its beat frequency, and thus with respect to the RF electrical signal fed to and the RF electromagnetic wave output by the corresponding antenna 72.

Figure 1B:
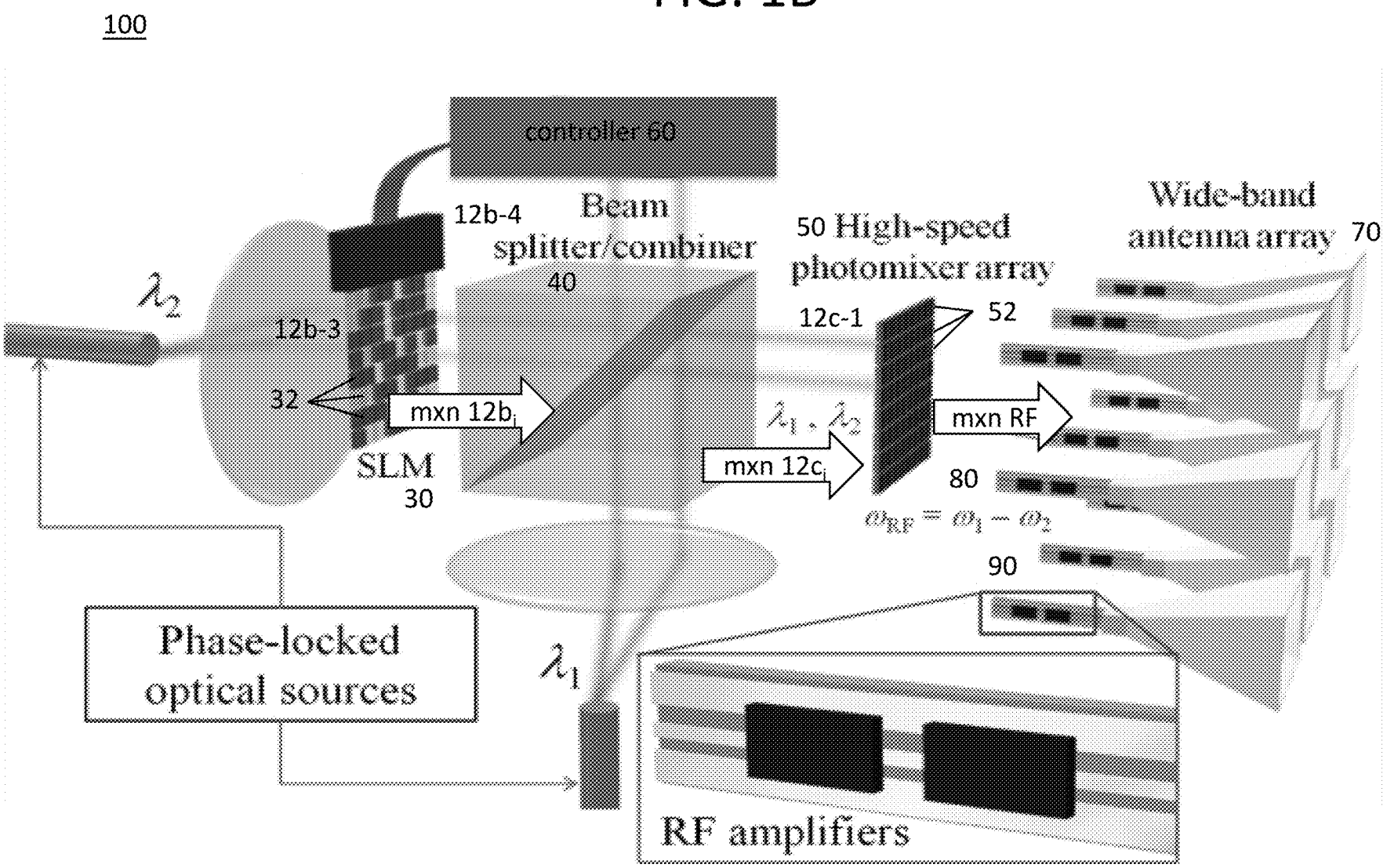

FIG. 1B illustrates a perspective view of the transmitter 100 to explain further details of such separate phase modulation of portions of optical beam 12*b* by SLM 30. As shown in FIG. 1B, SLM 30 is comprised of a two dimensional matrix of SLM pixels 32. Each SLM pixel 32 may be separately controlled by controller 60 to provide a different phase delay of a portion $12b_i$ of light beam 12*b* that is transmitted therethrough (and/or impinged thereon). In this example, the SLM pixels 32 are arranged two dimensionally in an m×n matrix (e.g., m rows and n columns) of SLM pixels 32. The individually modulated portions $12b_i$ of the light beam 12*b* are thus organized in a similarly arranged m×n matrix of light beam portions $12b_i$, such arrangement corresponding to the arrangement of the SLM pixels 32. It will be appreciated that together the m×n portions $12b_i$ form modulated light beam 12*b*-4 discussed herein and that each of these portions $12b_i$ may also be considered a separate light beam. Also, while the SLM 30 is arranged in am×n matrix of rectangularly shaped pixels 32 arranged in rows and columns, other arrangements of SLM pixels 32 may be used, such as use of triangularly shaped or hexagonally shaped pixels being linearly arranged in three directions in a two-dimensional plane (e.g., the SLM 30 may be divided by different types of grids, with each pixel 32 forming a grid element of the SLM 30). In addition, a linear array of light beam portions $12b_i$ may be formed (e.g., a light beam portions 12*b* arranged along a single line) rather than a two dimensional arrangement.

The m×n portions $12b_i$ of light beam 12*b* are then combined with collimated light beam 12*a*-3 by beam splitter/combiner 40 to form an m×n matrix of modulated combined light beam portions $12c_i$ (together forming combined light beam 12*c*-1 discussed herein). Each modulated combined light beam portion $12c_i$ is then impinged on a corresponding photodetector (e.g., photodiode) 52 of the photomixer array 50 which generates a corresponding RF electrical signal. As shown in FIG. 1B, the photomixer array 50 is formed as a m×n array of photodetectors. The physical arrangement of the SLM pixels 32 may correspond to the physical arrangement of the photodetectors 52 of the photomixer array 50, as well as to the spatial arrangement of the m×n modulated light beam portions $12b_i$ and modulated combined light beam portions $12c_i$.

Thus, m×n RF electrical signals are generated by the photomixer array 50 and provided to a corresponding one of m×n antenna elements 72 forming antenna array 70. The arrangement of the antenna elements 72 may have the same or different spatial arrangement as the arrangements of the SLM pixels 32 and photodetectors 52.

As noted, each of the antennas 72 in the transmitter antenna array 70 transmits an RF electromagnetic wave at a frequency determined by or as a function of the wavelength offset (or difference) between the first and second optical beams 12*a*, 12*b*. The RF electromagnetic wave frequency (antenna operating frequency) may be substantially the same as the inverse of the wavelength offset. For example, if the RF reference 16 of FIG. 2 has a frequency of 50 GHz, the antennas 72 may operate with an RF carrier frequency substantially equal to 50 GHz. In some examples, the frequency difference of the first and second optical beams may be an integer multiple of the frequency of the signal generated by the RF reference 16. For example, when the phase-locked optical source 10 is implemented as a TOPS, a comb of harmonics may be generated form the signal provided by the RF reference 16 (having frequencies of integer multiples of the frequency of the RF reference 16), and one of these harmonics may be selected as the frequency difference between the first and second optical beams 12*a*, 12*b*. Thus, changing either the frequency of the RF signal generated by the RF reference 16 or the selected harmonic may change the carrier frequency of the electromagnetic wave output by the antenna array 70.

As noted, the positions of each of the photodiodes 52 of the photomixer array 50 may correspond to positions of the pixels 32 of the SLM 30. Alternatively, light guides (not shown) may be interposed between the beam splitter/combiner 40 and the photomixer array 50 to separately transmit and/or redirect the modulated combined beam portions 12$c_i$ output by the pixels 32 of the SLM to photodiodes that have some other arrangement than corresponding to pixels of the SLM. For example, a two dimensional array of lenslets may be provided in the location of the photomixer array 50, with each lenslet replacing a corresponding photodiode (in location) of that described herein with respect to FIGS. 1A and 1B.

Figure 4A:
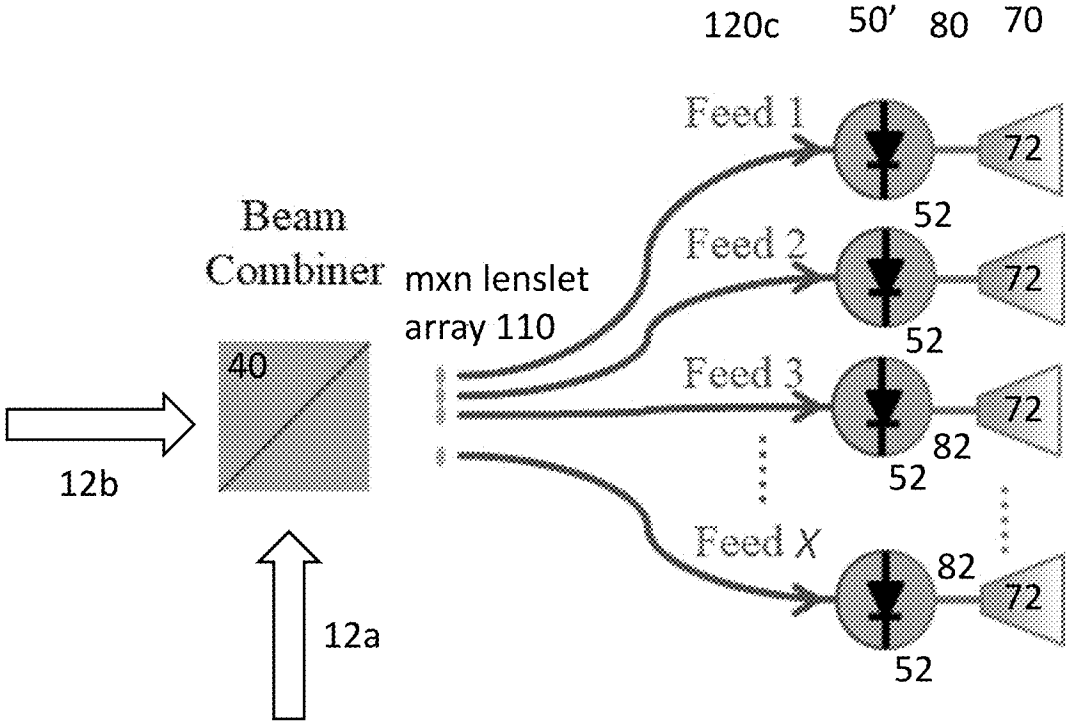
FIG. 4A illustrates an example using a lenslet array to capture modulate light beam signals that may be implemented with the transmitter of FIGS. 1A and 1B.

FIG. 4A illustrates such an example including a two dimensional array of m×n lenslets 110 (simplified side view of lenslet array 110 shown in FIG. 4A). Each lenslet of the lenslet array 110 may be located at a position to capture a corresponding modulated combined beam portion 12$c_i$ and inputting the same to a corresponding optical fiber (forming one of feeds Feed 1, Feed 2, . . . Feed X) of fiber bundle 120. These fibers may then output their corresponding combined beam portion 12$c_i$ onto a photodiode 52 at some downstream location, such as adjacent to the antenna 72. The optical path lengths of each of the feeds Feed 1, Feed 2, . . . Feed X may be the same, such as by using optical fibers of fiber bundle 120*c* of substantially the same length. Alternatively, the optical path lengths of each of the feeds Feed 1, Feed 2, . . . Feed X may be adjusted by introducing a variable phase delay element (e.g., lithium niobate phase delay) that may be controlled to provide the same optical path length for each of the feeds.

FIG. 4A illustrates RF transmission lines 82 formed between each photodiode and antennas pair 52/72. However, in some examples, the electrical connection between the photodiode 52 and antenna 72 may be less than one half the wavelength of the RF operational wavelength (e.g., corresponding to the inverse of the RF operational frequency) of the antenna 72 and use of RF transmission lines 80/82 may be avoided (e.g., replaced by a single conductive wire having a length less than one half the wavelength of the RF operational frequency). RF amplifiers 90 may also be avoided when the signal strength of the RF signals generated by the photomixer array 50 is sufficiently strong. The lenslet array 110, fiber bundle 120*c* and photodiodes 50' of FIG. 4A may be used instead of the photomixer array 50 shown in FIGS. 1A and 1B. As all remaining structure and operation may be the same as described with respect to the transmitter of FIGS. 1A and 1B, repetitive description is omitted.

Figure 4B:
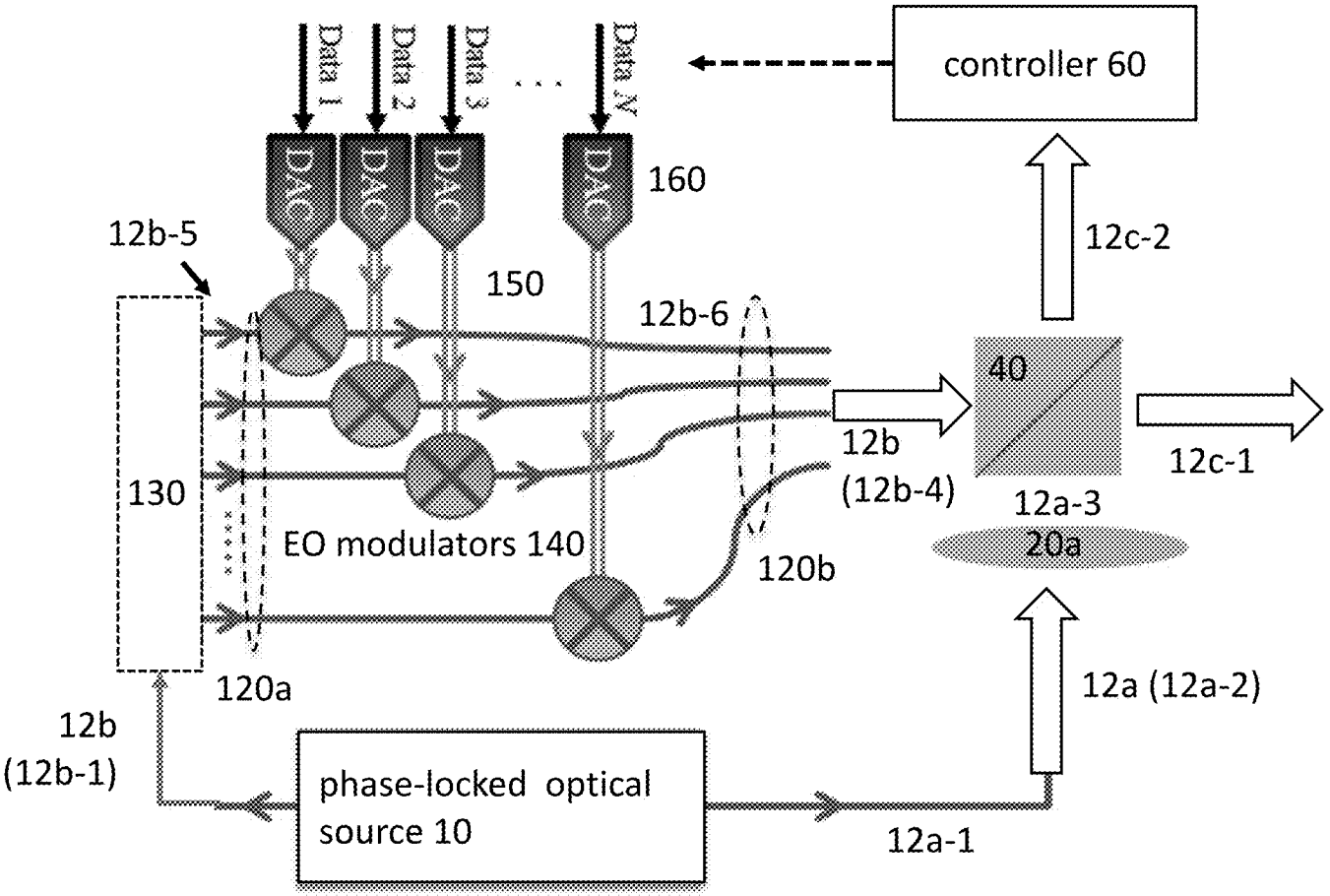
FIG. 4B illustrates an exemplary modulation of light beams that may be implemented with the transmitter of FIGS. 1A and 1B.

FIG. 4B illustrates an alternative modulation of the light beam 12*b* that may be implemented with the transmitter of FIGS. 1A and 1B. As shown in FIG. 4B, a plurality of beams 12*b*-5 are formed by splitting optical beam 12*b*-1 output by the phase-locked optical source 10 by beam splitter 130. Each of the beams 12*b*-5 are transmitted by an optical fiber of optical fiber bundle 120*a* to a corresponding electro-optic (EO) modulator 140 where it may be modulated in phase and/or amplitude by respective analog signals 150 generated from a digital analog converter in response to respective data (Data 1, Data 2 . . . Data N) provided by controller 60 and output as a modulated beam 12*b*-6. Each EO modulator 140 may correspond to a pixel 32 of the SLM 30 and modulate a beam 12*b*-5 in the same manner (e.g., in phase and/or amplitude) as described herein.

Each modulated beam 12*b*-6 is output from an EO modulator 140 on a corresponding optical fiber of fiber bundle 120*b*. The group of modulated beams 12*b*-6 output from the EO modulators 140 may form modulated beam 12*b*-4 of FIGS. 1A and 1B upon their output from the fiber bundle 120*b* into free space or other transparent medium to be input into beam splitter/combiner. 40. Specifically, as noted, portions 12$b_i$ of light beam 12*b*-4 may each be considered a separate light beam each portion 12$b_i$ and may correspond to one of the modulated beams 12*b*-6. Specifically, each fiber of fiber bundle 120*b* may terminate at the same plane (with the axes of the optical fibers of fiber bundle 120*b* at their termination ends being perpendicular to this plane). The light of the group of modulated beams 12*b*-4 emitted into free space (or other transparent medium) may be collimated so that the light beams 12*b*-4 may be transmitted to the splitter/combiner 40 in parallel without interfering with one another (lenses may be formed at the end of the fibers to facilitate this collimated formation). Although a two-dimensional array (e.g., m×n matrix of light beams 12$b_i$ or other configurations as described herein) can be formed at the output of the fiber bundle 120*b*, a linear array may also be formed. As all remaining structure and operation may be the same as described with respect to the transmitter of FIGS. 1A and 1B (including alternative structure and operations, such as that of FIG. 4B), repetitive description is omitted.

Figure 4C:
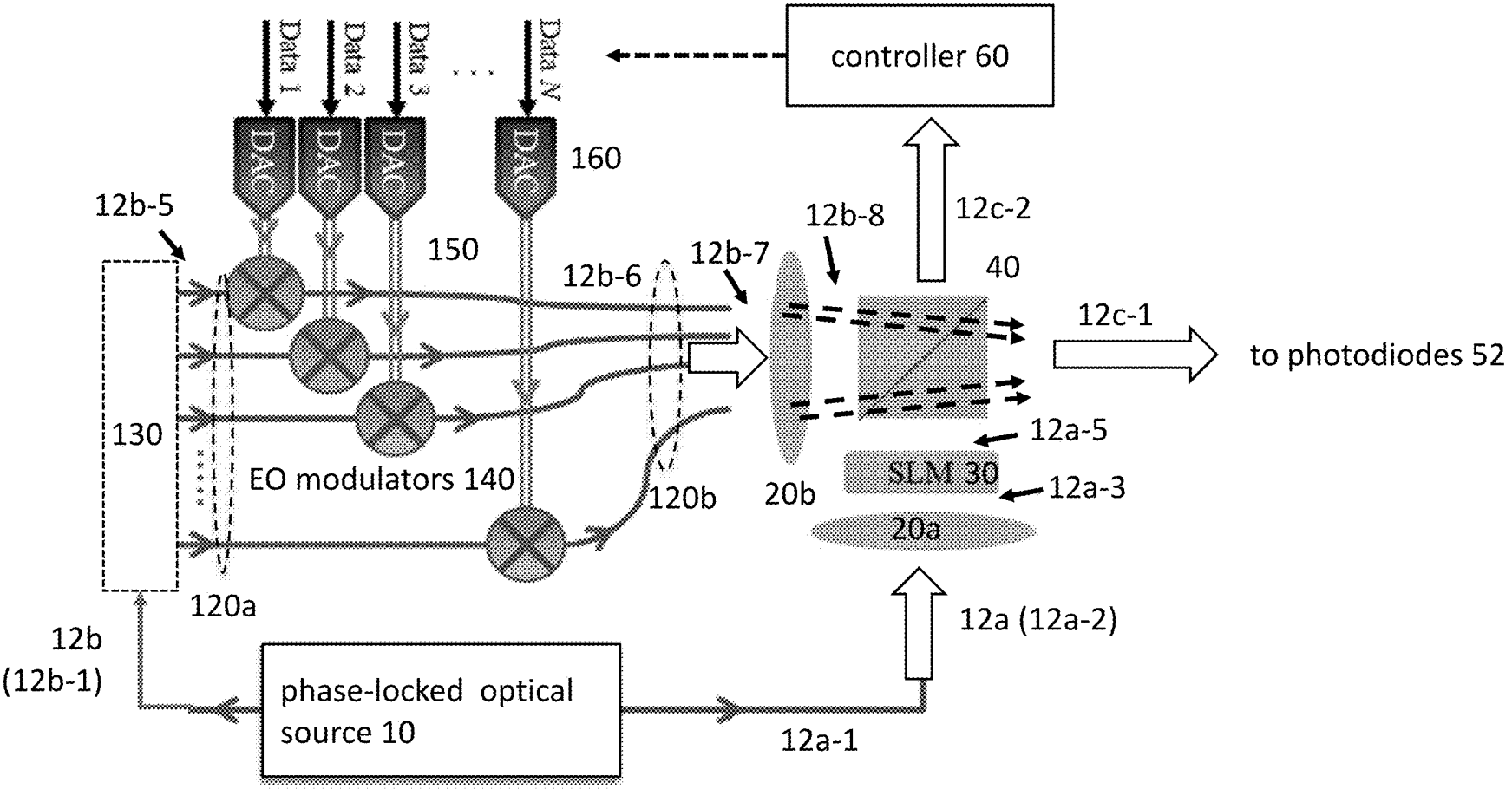
FIG. 4C illustrates further alternative details that may be implemented with the transmitter of FIGS. 1A and 1B.

FIG. 4C illustrates further alternative details that may be implemented with the transmitter 100 of FIGS. 1A and 1B. As shown in FIG. 4C, both the first light beam 12*a* and the second light beam 12*b* are subject to modulation prior to being combined and split by beam splitter/combiner 40. In this example, SLM 30 is used to modulate first light beam 12*a* (in its collimated form 12*a*-3 after output by lens 20*a*) to form modulated first light beam 12*a*-5. The modulation by the SLM 30 of the first light beam 12*a* may be the same as that described herein with respect to modulation of the second light beam 12*b* by the SLM 30 and the modulated first light beam 12*a*-5 may have the same form as modulated second light beam 12*b*-4 output by the SLM 30 as described herein (e.g., with respect to the FIGS. 1A and 1B). As shown in FIG. 4C, the second light beam 12*b* is also modulated by EO modulators 140 (e.g., as described with respect to FIG. 4B) to generate modulated light beam 12*b*-4. Both modulations by EO modulators 140 and SLM 30 may cause a corresponding modulation of the beat frequency of the resultant portion of the combined beam 12*c*-1 and combined beam 12*c*-2, and thus a corresponding modulation of the resultant RF signal generated by the corresponding photodetector 52 (and the electromagnetic signal generated by the corresponding antenna element 72).

Modulation of both the first beam 12*a* and second beam 12*b* may assist in separately controlling different aspects of the electromagnetic RF signals produced by the antenna array 70. For example, EO modulators 140 may modulate first light beam 12*b* to encode data of an RF channel (e.g., produced by a corresponding RF beam) for transmission of encoded information by the transmitter 100. Modulation by SLM 30 may be used to adjust channel formation, e.g., to adjust and/or control RF beam formation of the spatially separate RF beams formed by the antenna array 70. SLM 30 may use channel state information to adjust control channel formation via modulation of first light beam 12*a* while EO modulators 140 may use data streams Data 1, Data 2, . . . Data N (e.g. each corresponding to data of a communication link) to modulate second light beam 12*b*. As noted herein, modulation of both the first light beam 12*a* and the second light beam 12*b* may be implemented as part of any of the embodiments described herein, including the particular configuration illustrated in FIG. 4C.

FIG. 4C also illustrates an alternative where light beam 12*b* is input into beam splitter/combiner 40 as a plurality of collimated beams 12*b*-8. Each of the plurality of collimated beams 12*b*-8 is formed by a corresponding one of the modulated beams 12*b*-6. Each modulated beam 12*b*-6, upon being output by an optical fiber of bundle 120*b* into free space (or other transmissive medium), may diverge (e.g., widen in the shape of a cone) prior to being transmitted through collimating lens 20*b* and form a diverged modulated beam 12*b*-7. The plurality of diverged modulated beams 12*b*-7 may correspond to 12*b*-4 with respect to arrangement. Collimating lens 20*b* may then collimate each diverged modulated beam 12*b*-7 to form a plurality of collimated beams 12*b*-8 directed to the focal plane of the collimating lens 20*b* through beam splitter/combiner 40. The collimating lens 20*b* thus converts a plurality of point source inputs (each modulated beam 12*b*-6 being output from an optical fiber as an optical point source) into a plurality of corresponding collimated beams 12*b*-8. An offset in the location of a point source (e.g., offset in the location of the end of an optical fiber of bundle 120*b*) from the optical axis of the collimating lens 20*b* produces a tilted collimated beam 12*b*-8.

Figure 5A:
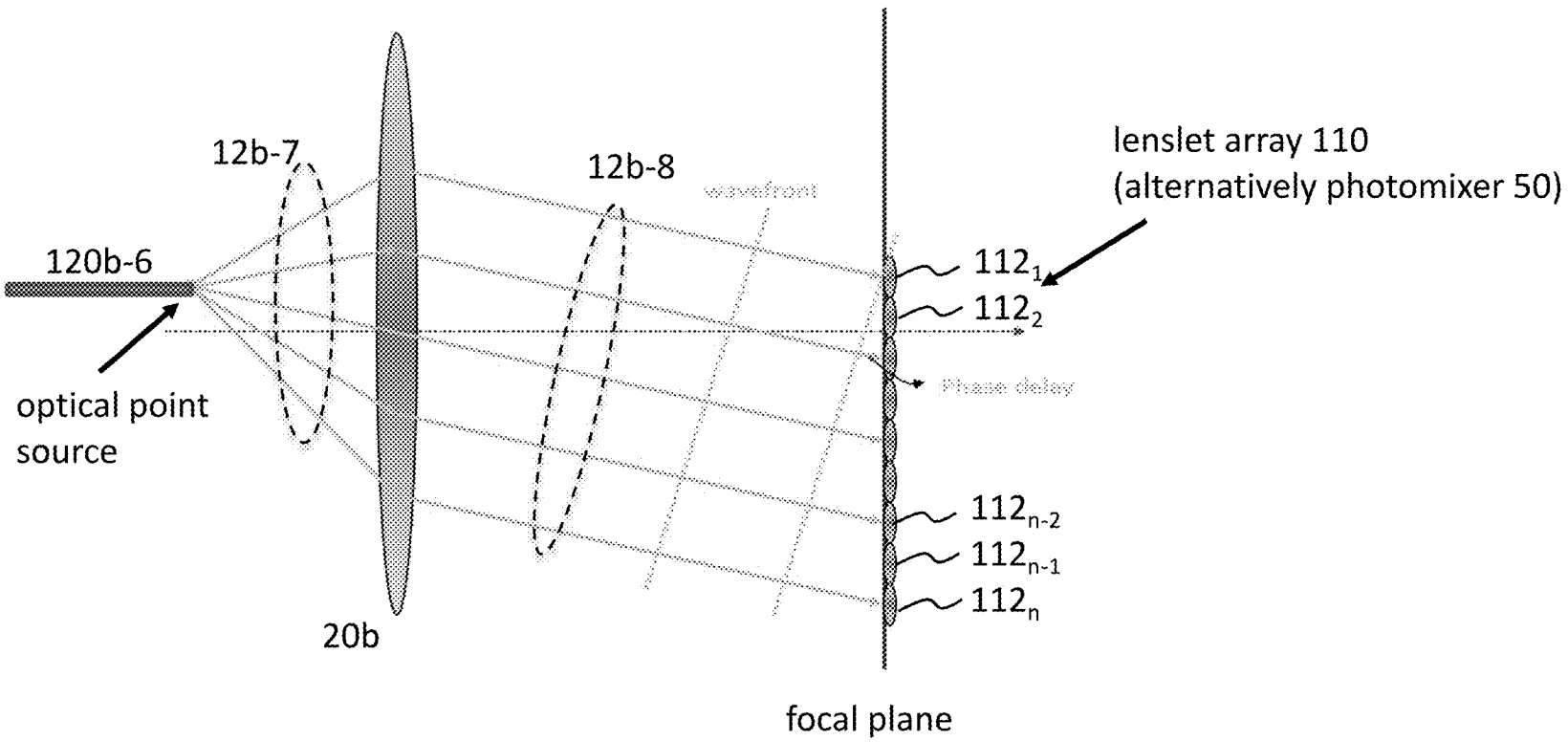
FIG. 5A illustrates an example of the formation of a collimated beam from a modulated beam.

FIG. 5A illustrates an example of the formation of a collimated beam 12*b*-8 from a modulated beam 12*b*-6 emitted as an optical point source from an optical fiber of bundle 120*b*. For clarity, portions of the following discussion is made with respect to portions of beam 12*b* (e.g., collimated beam 12*b*-8) without reference to its combination with beam 12*a* by combiner 40. In addition, it should be appreciated that a plurality of combined beams 12*c* (formed by beam 12*a* and a plurality of modulated collimated beams 12*b*-8) are together combined to impinge on a lenslet array 110 or photomixer 50.

As shown by FIG. 5A, the collimated beam 12*b*-8 formed by collimating lens 12*b*-8 has a wavefront perpendicular to its propagation direction. The collimated beam 12*b*-8 has a uniform intensity distribution and constant phase in the plane that is normal to the propagation direction of the beam 12*b*-8. It can thus be appreciated that as the collimated beam 12*b*-8 intersects and/or passes through the focal plane of the collimating lens 20*b* (or other planes parallel to the focal plane and/or that are not perpendicular to the propagation direction of collimated beam 12*b*-8), the phase of the portions of the beam 12*b*-8 at the focal plane differ.

FIG. 5A shows beam 12*b*-8 is impinged upon lenslet array 110 positioned at the focal plane of the collimating lens 20*b*. It should be appreciated that photomixer 50 may be provided at this location rather than the lenslet array 110 as shown in FIGS. 1A and 1B. In such a case, the photodiodes 52 of the photomixer 50 immediately convert the received optical signal to corresponding RF signals, rather than capturing the received optical signal with the lenslet array 110 and transmitting the received optical signal to the photodiodes 52 (e.g., as described with respect to FIG. 4A).

In the example of FIG. 5A, the lenslets 112 of the lenslet array 110 are arranged with a constant pitch, providing a constant spacing between neighboring lenslets 112. Thus, a constant phase delay increment (or constant phase shift) is provided between immediately neighboring lenslets 112 with respect to the portion of beam 12*b*-8 each lenslet receives. Thus, for a row or column of equally spaced n lenslets, the phase difference of portions of the beam 12*b*-8 received by lenslets $\mathbf{112}_i$ and $\mathbf{112}_{i+1}$ (i.e., immediate neighbors) may be the same offset amount for each pair of immediate neighbors (e.g., same phase increment or phase shift).

It should be appreciated that while FIG. 5A is a side view showing a single vertical column of lenslets, the lenslet array 110 may be a two-dimensional array. Phase offsets with respect to immediately neighboring lenslets 112 of other regularly arranged lenslets aligned in other directions (e.g., a row direction extending in and out of the plane of FIG. 5A) may also be constant for such direction. For example, for a row of lenslets arranged in a line extending in and out of the plane of FIG. 5A, each pair of immediately neighboring lenslets may obtain portions of beam 12*b*-8 that are offset by the same phase shift/phase increment (for all immediately neighboring pairs of lenslets in the row). It should be apparent that because the phase shift is a function of the direction of propagation of the beam 12*b*-8 with respect to the directions of the column and row of lenslets 112, for any one beam 12*b*-8, the phase increments experienced between lenslets 112 aligned in a row of the lenslet array 110 may differ from the phase increments experienced between lenslets 112 aligned in a column of the lenslet array 110.

Each of the beams 12*b*-8 may thus be received by the lenslet array 110 at a different angle (e.g., have a different angle of incidence with respect to the plane of the two-dimensional lenslet array 110). The constant phase shift between portions of the beams 12*b*-8 captured by the lenslet array 110 differ in dependence on the angle of incidence of each of the beams 12*b*-8, each of the beams may correspond to a different RF beam formed by the antenna array 70. Thus, data Data 1, Data 2, . . . Data N modulated onto the different beams 12*b*-8 may be transmitted with respective RF beams by antenna array 70 to separate sectors (different physical locations) without interference between other RF beams formed by the antenna array 70.

Figure 5B:
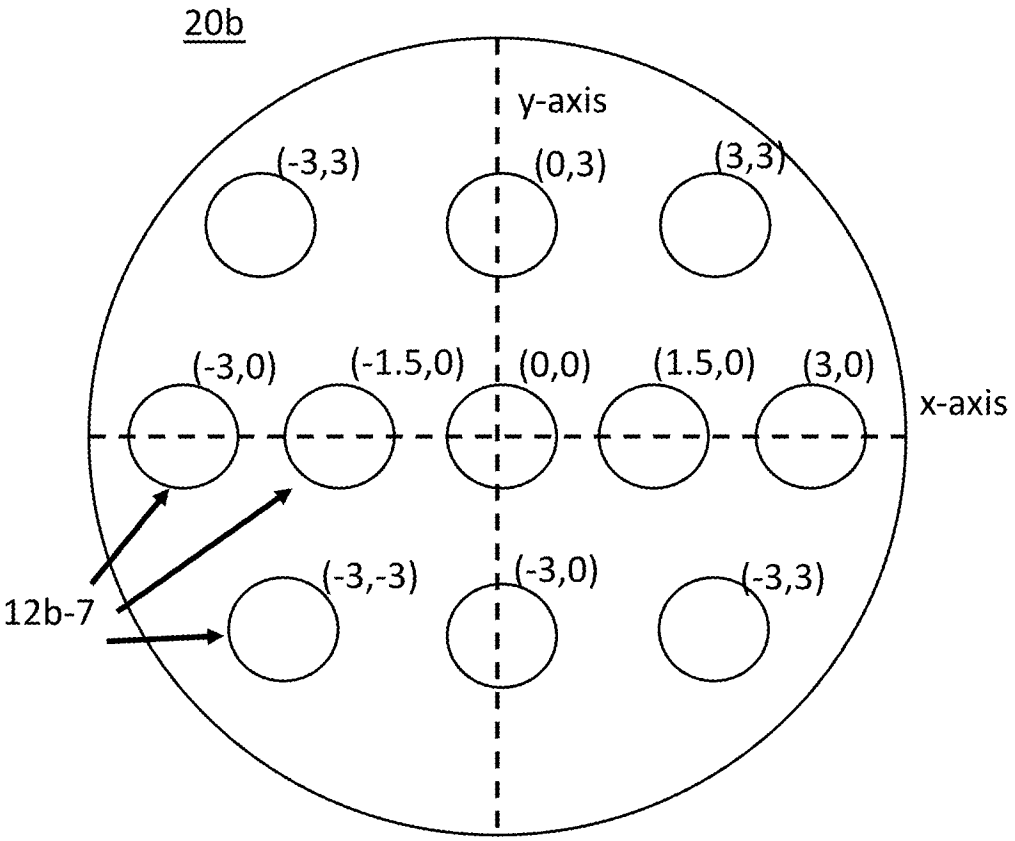
FIG. 5B provides a simplified representation of a rear view of a lens.

FIG. 5B provides a simplified representation of a rear view of lens 20*b* (the input side of lens 20*b*), showing locations of impingement of several diverged beams 12*b*-7. Offsets of the diverged beams 12*b*-7 form the optical axis (e.g. center at (0,0)) may correspond to the incremental phase shifts between neighboring lenslets of a resultant collimated beam 12*b*-8 impinged on the lenslet array 110, which in turn corresponds to (and may be the same as) the resultant incremental phase shift of RF signals generated by the photodiodes 52 corresponding to the resultant collimated beam, and in turn corresponds to the beam direction of the corresponding RF beam formed by the antenna array 70 from these RF signals. Thus, diverged beam 12*b*-7 at (3,0) may result in a RF beam formed by antenna array 70 to be steered to the right from its emission from the antenna array 70, while diverged beam 12*b*-7 at (0,0) may be emitted from the antenna array 70 without any beam steering, while diverged beam 12*b*-7 at (−3,0) may be steered to the left of the antenna array 70. RF beams formed by diverged beams 12*b*-7 at (0,3) and (−3,0) may be steered upwardly and downwardly, respectively, while beams formed by diverged beams 12*b*-7 at (−3,3), (3,3), etc., may have beam steered in both horizontal and vertical directions of by the antenna array 70.

Figure 4D:
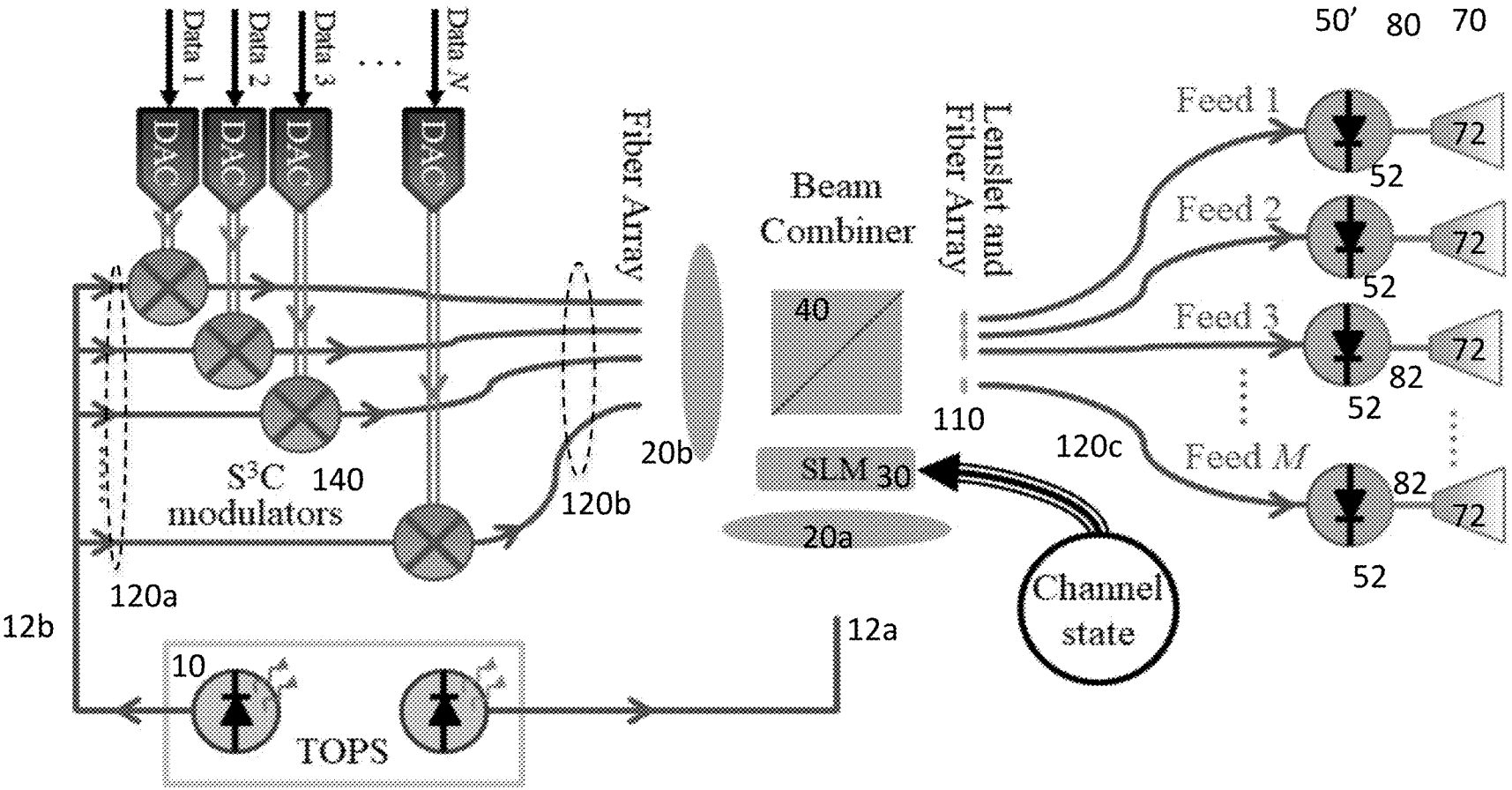
FIG. 4D illustrates an example that combines the alternative structures that may be suitable for a MIMO network.

FIG. 4D illustrates an example that combines the alternative structures described with respect to FIGS. 4A and 4C. As such, repetitive description may be omitted. FIG. 4D shows the architecture of an optically fed transmitter 100 for multi-user MIMO network. The tunable optical paired source (TOPS) 10 generates two beams of laser light 12*a*, 12*b* having wavelengths offset by the desired RF carrier frequency; the lasers are injection phase-locked to ensure pure RF-tone generation with low phase noise. One of these optical beams 12*b* is split N ways with an optical splitter (interposed between the TOPS and electro-optic modulators—not shown), where N is the number of spatial sectors (e.g., spatially separate real world locations) covered by the transmitter 100. Each of the N optical beams is modulated by a corresponding electro-optic modulator 140 in phase and/or amplitude with a respective data stream (Data 1, Data 2, . . . Data N) encoded into a desired I/Q constellation such as OOK, QPSK, 16 QAM, or higher order modulation schemes. The electro-optic modulators 140 used in this example may be of single-sideband suppressed carrier (S3C) variety, and the modulator outputs are gathered into a fiber array that is placed in a focal plane of lens 20*b*. Each fiber serves as a point source to the optical lens system to produce a collimating plane wave and arrive on the receiving lenslet-and-fiber array (110, 120*c*) with linear phase distribution across the receiving array. If needed, an additional RF mixer (not shown) may be used prior to electro-optic modulation to shift the individual data streams from baseband to a sub-carrier or intermediate frequency IF. As a result, N optical beams are formed in free space, with each beam illuminating a lenslet-and-fiber array (110, 120*c*) through a beam combiner (40). Each of the N optical beams contains a single modulation sideband corresponding to a data stream (one of Data 1, Data 2, . . . Data N) destined for the respective sector.

The light of the other optical beam 12*a* (of different wavelength) generated by the TOPS serves as a reference and is routed to the focal plane of a second lens 20*a* placed at the other input port of the beam combiner 40. Prior to combining the reference beam 12*a* with the N modulated beams, the wave-front of the reference light 12*a* may be additionally modified (e.g., phase shifted and/or amplitude modulated) with a spatial light modulator (SLM) 30 that takes into account the channel state in the RF environment. The SLM 30 is optional. In the absence of an SLM, the reference beam 12*a* produces a flat phase across the lenslet-and-fiber array (110, 120*c*); in the absence of an SLM 30, the portions of the reference beam 12*a* input to each of the M feeds of the receiving fiber array (e.g., at each of the lenslets and/or fibers) are in phase. Thus, each of the M optical fibers at the output of the beam combiner 40 (forming the receiving fiber array) receives the optical reference light 12*a* (provided by lens 20*a*—which may or may not be modulated by the SLM) and portions of each of the N modulated optical beams (provided by lens 20*b*).

The relative positions of the inputs of the receiving fiber array 120*c* may correspond to the relative positions of the antenna elements 72 to which they provide their signals. The optical path lengths of each optical path of the receiving fiber array 120*c* (corresponding to each fiber may be the same and may be formed by the optical path length of the corresponding fiber only or by the optical path length of the corresponding fiber and an adjustable optical delay element (or adjustable phase delay), such as lithium niobate.

In some examples, the xi,yi locations of the inputs of the receiving fiber array may correspond to the xi',yi' locations of the antenna elements of the antenna array, where (xi,yi)=n×(xi',yi') for each of i=1 to M (although it should be appreciated that the relative Cartesian coordinate system and its origin for the receiving fiber array inputs and the antenna array would likely, but not necessarily, be different). The inputs of the receiving fiber array 120*c* may be planar (e.g., zi may be the same for each of the M feed inputs) and the antenna array 70 may be planar (e.g., zi' may be the same for each of the M antenna elements). In some examples, offsets in zi and/or zi' (e.g., to provide nonplanar inputs of the receiving fiber array and/or antenna array, respectively) may be accommodated by adding a phase delay in the corresponding optical feed. It should be appreciated that the use of the variable "i" herein refers each of the elements of a set (e.g., a set of N or M) individually.

Through the optical lens 20*b*, each one of the N modulated beams from the left of the lens 20*b* is collimated into a corresponding plane wave to realize uniform amplitude. Upon being input to the receiving fiber array 120*c*, for each one of the N modulated beams, portions thereof are phase offset in dependence on the optical path length of the different portions of each modulated beam. For example, each modulated beam may have a linear phase offset with respect to its portions distributed across the receiving fiber array 120*c*. Each of the M optical fibers of the receiving fiber array 120*c* may receive a corresponding combined beam comprising corresponding portions of each of the N modulated beams with corresponding linear phase offset (with respect to neighboring optical fibers receiving and corresponding modulated beams) and reference light 12*a* with flat phase (e.g., reference light 12*a* in phase at each of the inputs to the receiving fiber array) from the reference TOPS across the array.

Each of the fibers feed such a corresponding combined optical beam to a corresponding one of the photo-diodes 52. Each of the photo-diodes 52 is coupled to a corresponding antenna element 72 (e.g., a corresponding horn antenna) of an antenna array 70. Each photodiode 52 converts a corresponding combined optical beam to an RF signal as described herein (e.g., with an RF frequency equal to the frequency offset of the two beams of laser light 12*a*, 12*b* produced by TOPS). With respect to a single combined optical beam (formed from only one of the fibers of optical fiber bundle 120*b*), RF modulation of the RF signal produced by each photodiode 52 may thus be controlled by the corresponding electro-optic modulator 140 (and if used, the pixel of the SLM) as described herein.

Each of the photodiodes 52 mix the optical reference with the modulated optical beam 12*b* to produce an RF signal that contains information of all data streams (Data 1, Data 2, . . . Data N). The combination of the RF electromagnetic signals emitted from the antenna elements 72 form RF beams in free space. Each of the RF beams may be separately controlled to radiate in a corresponding desired direction. This way, each of the collimated beams 12*b*-8 formed in optical domain by lens 40 becomes an RF beam transmitted by the antenna array 70. The wavefront of the RF beams may be additionally modified with the SLM 30 (e.g., as discussed herein) to take RF channel state information into account when forming the RF beams.

Each modulated beam 12*b* output on a fiber of fiber bundle 120*b* may produce a sector beam in free space through interference between channels by virtue of all of "M" channels of receiving fibers 120*c*, photodiodes 52, and antennas 72 (all of the channels after the lens 20*b*). Adding an additional modulated optical beam (12*b*-6) will produce an additional RF sector beam in free space that is independent of other RF sector beams. "N" channels of the modulated beams 12*b*-6 will produce "N" sectors of RF beams by the antenna array 70. When all of the N modulated data streams (Data 1, Data 2, . . . Data N) are incorporated, all channels downstream of the beam combiner 40 carry all of information from all of the N modulated beams. The interference between the corresponding modulated signal (12*b*-6) and reference light 12*a* forms multiple RF sector beams emitted from the antenna array 70 that point towards corresponding sector directions. All RF sector beams may be formed independently from each other.

In general, direction of the RF sector beam output by the antenna array 70 may be a function of the position of the modulated beam output from a fiber of fiber bundle 120*b* onto the lens 20*b* (e.g., a function of the position of the optical fiber carrying the modulated beam 12*b*-6). The location of the output of the modulated beam 12*b*-6 at the lens 20*b* determines the difference in optical paths the portions of that modulated beam to their respective inputs to the feeds of the receiving fiber array, which in turn determines the respective phase offset of these portions. For each modulated beam, phase offsets may regularly increase (e.g., in a substantially linear manner) in a first direction with respect to its input to the receiving fiber array 120*c*.

The phase offsets of such portions of an ith one of the N modulated beams as input into the receiving fiber array 120*c* correspond to the phase offsets of the RF signals generated by the corresponding antennas 72 of the antenna array 70 corresponding to that ith modulated beam (the full RF signal generated by an antenna array 70 may include superimposed portions of RF signals corresponding to all of the N modulated beams). The generation of RF signals by each photodiode antenna pair (52, 72) corresponds in phase and amplitude to the optical signal fed to the photodiode antenna pair (as described herein). Thus, for an ith one of the N modulated signals, the regularly increasing or decreasing phase offsets (which may be substantially linear) of portions of the modulated beam across the input of the receiving fiber array 120*c* correspond to and are reproduced in the RF signals output by the antenna elements 72 of the antenna array and thus act to steer the corresponding RF beam to a particular spatial sector.

Thus, for the N data streams, the system may include N electro-optic modulators, that separately modulate N portions of a first optical beam 12*b* split N ways, with the modulated N portions of the first optical beam 12*b* transmitted through a beam combiner 40 to M optical waveguides (e.g., M optical fibers) 120*c*. The number of N data streams may be not be the same as the M receiving optical waveguides 120*c* (optical fibers). The beam combiner 40 combines the N modulated beams with reference light 12*a*. The first optical beam 12*b* (and thus the N modulated beams) and the reference light 12*a* are generated by the TOPS to have wavelengths that are offset from each other as described herein. M receiving fibers capture the combined beams with each directed to a corresponding one of M photodiodes 52 by a corresponding one of M optical waveguides 120*c* (e.g., M additional optical fibers). The M photodiodes 52 generate M RF signals, each of which controls and/or drives a corresponding one of the M antenna elements 72 of the antenna array 70. When an SLM 30 is implemented, M pixels of the SLM 30 may separately modulate M portions of the beam of reference light 12*a* to tune the phase in each of M optical fibers 120*c*. Each SLM pixel may correspond to and be dedicated to one optical fiber 120*c* (i.e., not shared with other optical fibers 120*c*).

Depending on implementation, lenses or other light guides may be interposed between fiber optic inputs to the beam combiner. The lenses may be collimating lenses, e.g. In some examples, each optical fiber (e.g., such as those outputting light to the beam combiner) may be provided with a separate lens to separately collimate the light output by each optical fiber.

A transmitter to be used in wireless multi-user MIMO has been described. The system combines the virtues of digital, analog and optical processing to arrive at a solution for scalable, non-blocking, simultaneous transmission to multiple devices (e.g., mobile devices or other user equipment (UE-s). The system architecture is independent of the RF carrier frequency, and different frequency bands can be accessed easily and rapidly by tuning the optical source (TOPS). The data channels are established in the digital domain and the RF beam-forming accuracy is only limited by the available resolution of DAC, which can be as high as 16 bits for 2.8 GSPS in off-the-shelf components.

The antenna transmitters described herein may operate and communicate with a wide range of radio frequencies, such as millimeter wave (e.g., about 30 to 300 GHz), microwave (e.g., 1 to 170 GHz), SHF (3 GHz to 30 GHz), UHF (300 MHz to 3 GHz), VHF (30 to 300 MHz), to radio frequencies as low as 300 KHz or even 30 KHz. The invention may also be used with other communication frequencies outside of radio frequencies. Higher frequencies above millimeter wavelength frequencies (e.g., terahertz radiation band between infrared light and millimeter wavelength RF), with a dependence on the ability to convert the beat frequency of the interfering light beams to an electromagnetic wave. It will be appreciated that while a transmitter 100 may dynamically change the range of frequencies that may be transmitted, real time alteration of the carrier frequency will be limited by the type of antenna of the antenna array 70 (although, these may be physically replaced with other antennas by a user).

The light beams 12*a*, 12*b* described herein may be visible light or invisible light (e.g., infrared, ultraviolet). Use of other waveguides other than a fiber optics may also be implemented, however widespread availability and ease of use of fiber optics make such waveguides preferable.

Although aspects of embodiments of the present invention has been described, it will be appreciated that the invention may take many forms and is not limited thereto. It will be apparent to those skilled in the art that various substitution, modifications and changes may be made with respect to the disclosed embodiments without departing from the scope and spirit of the invention.

What is claimed is:

1. A method of operating an array of antennas comprising:

generating a reference optical beam and a first optical beam, the reference optical beam and the first optical beam having different frequencies;

modulating the first optical beam;

combining the modulated first optical beam and the reference beam;

inputting the modulated first optical beam as combined with the reference beam at a plurality of locations arranged at a first plane by propagating the modulated first optical beam through free space and a collimating lens to meet the first plane at a first acute angle to generate radio frequency (RF) electrical signals, the plurality of locations have a constant phase offset with respect to a linear direction along the first plane and each RF electrical signal corresponding to one of the plurality of locations has a constant phase delay in accordance with the constant phase offset; and operating each of the antennas of the array of antennas with a corresponding one of the RF electrical signals.

2. The method of claim 1, wherein inputting the modulated first optical beam as combined with the reference beam at the plurality of locations arranged at the first plane comprises impinging the first optical beam as combined with the reference beam on an array of photodetectors arranged at the first plane.

3. The method of claim 1, wherein inputting the modulated first optical beam as combined with the reference beam at the plurality of locations arranged at the first plane comprises impinging the first optical beam as combined with the reference beam on an array of lenslets arranged at the first plane.

4. The method of claim 1, further comprising transmitting via optical fibers portions of the modulated first optical beam as combined with the reference beam to corresponding photodiodes, wherein each photodiode generates a corresponding one of the RF signals in response to the corresponding of the modulated first beam as combined with the reference beam.

5. The method of claim 1, wherein the modulated first optical beam controls the generation of a first modulated RF beam to be beam steered in a first direction by the antenna array, and wherein the first direction is a function of the first acute angle.

6. The method of claim 1, further comprising:

generating a second optical beam having a frequency of the first optical beam;

modulating the second optical beam;

combining the modulated second optical beam and the reference beam; and inputting the modulated second optical beam as combined with the reference beam at the plurality of locations arranged at the first plane to generate the radio frequency (RF) electrical signals, each RF electrical signal corresponding to one of the plurality of locations, wherein the modulated first optical beam controls the generation of a first modulated RF beam by the antenna array, and the modulated second optical beam controls the generation of a second modulated RF beam by the antenna array, and wherein the first and second RF beams are beam steered by the antenna array in different directions.

7. The method of claim 6, wherein inputting the modulated second optical beam as combined with the reference beam at the plurality of locations arranged at the first plane comprises propagating the modulated second optical beam to meet the first plane at a second acute angle different from the first acute angle.

8. The method of claim 7, wherein the modulated first optical beam controls the generation of a first modulated RF beam to be beam steered by the antenna array in a first direction, wherein the modulated second optical beam controls the generation of a second modulated RF beam to be beam steered by the antenna array in a second direction different from the first direction, and wherein the first direction is a function of the first acute angle and the second direction is a function of the second acute angle.

9. The method of claim 8, further comprising collimating the modulated first optical beam and collimating modulated second optical beam, wherein inputting the modulated first optical beam and inputting the modulated second optical beam comprises impinging the collimated first optical beam at the first acute angle and impinging the collimated second optical beam at the second acute angle onto either a photomixer array or a lenslet array arranged at the first plane;

combining the modulated spatially separate portions of the second optical beam with the first optical beam to form a plurality of modulated spatially separate combined light beam portions;

impinging the modulated spatially separate combined light beam portions onto an array of photodetectors to generate a plurality of corresponding RF electrical signals; and operating the array of antennas with the plurality of RF electrical signals.

10. The method of claim 1, wherein propagating the modulated first optical beam through free space and the collimating lens to meet the first plane at the first acute angle to generate radio frequency (RF) electrical signals, provides all the phases needed to steer the RF electrical signals by the antenna array.

11. A method of operating an array of antennas comprising:

generating a first optical beam having a first frequency and a plurality of second optical beams each having a second frequency offset from the first frequency;

separately modulating each of the second optical beams;

combining the modulated second optical beams and the first optical beam;

inputting each of the modulated second optical beams as combined with the first optical beam at a plurality of locations arranged at a first plane by propagating each modulated second optical beam through free space and a collimating lens to meet the first plane with a different corresponding propagation direction to generate radio frequency (RF) electrical signals, each RF electrical signal corresponding to one of the plurality of locations; and operating each of the antennas of the array of antennas with a corresponding one of the RF electrical signals, wherein each modulated second optical beam controls the generation of a corresponding RF beam emitted from the antenna array, and wherein each propagation direction of each modulated second optical beam with respect to the first plane corresponds to the direction of the corresponding RF beam emitted from the antenna array so that the different propagation directions result in different directions of the RF beam.

12. The method of claim 11, propagating each modulated second optical beam to meet the first plane with a different corresponding propagation direction comprises impinging the modulated second optical beams onto different corresponding locations of the collimating lens.

* * * * *